United States Patent [19]

Woods

[11] 4,107,054

[45] Aug. 15, 1978

[54] LUBRICATING OIL COMPOSITIONS

[75] Inventor: Warren W. Woods, San Diego, Calif.

[73] Assignee: Continental Oil Company, Ponca City, Okla.

[21] Appl. No.: 810,214

[22] Filed: Jun. 27, 1977

[51] Int. Cl.[2] ..... C10M 1/40; C10M 3/34; C10M 5/22; C10M 7/38

[52] U.S. Cl. ..... 252/33.4; 252/51.5 A; 252/52 R; 252/392

[58] Field of Search ..... 252/51.5 A, 33.4, 52 R, 252/392

[56] References Cited

U.S. PATENT DOCUMENTS

| | | | |
|---|---|---|---|
| 2,775,560 | 12/1956 | Lurton et al. | 252/48.6 |
| 2,809,160 | 10/1957 | Stewart et al. | 252/51.5 A |
| 3,245,908 | 4/1966 | Lowe | 252/51.5 A |
| 3,245,909 | 4/1966 | Lowe | 252/51.5 A |
| 3,245,910 | 4/1966 | Lowe | 252/51.5 A |
| 3,427,245 | 2/1969 | Hotten | 252/34.7 |
| 3,585,137 | 6/1971 | Bosniack et al. | 252/51.5 A |
| 3,591,496 | 7/1971 | Vickars et al. | 252/18 |
| 3,679,585 | 7/1972 | Brook et al. | 252/51.5 A |
| 3,897,350 | 7/1975 | Heiba et al. | 252/51.5 A |

*Primary Examiner*—Irving Vaughn

*Attorney, Agent, or Firm*—Bayless E. Rutherford, Jr.

[57] ABSTRACT

Lubricating oil compositions having improved corrosion inhibition are disclosed. The lubricating oil compositions comprise (a) a major amount of a base lubricating oil, (b) alkenyl succinimide dispersant, and (c) corrosion inhibiting amount of certain specific acidic derivatives of benzene (e.g. 2-amino-5-methylbenzoic acid). In one aspect the lubricating oil composition contains additionally a minor amount of an overbased sulfonate.

14 Claims, No Drawings

LUBRICATING OIL COMPOSITIONS

FIELD OF THE INVENTION

The invention is in the general field of lubricating oil compositions having improved corrosion (particularly rust) inhibition.

GENERAL BACKGROUND

It is well-known that in the operation of internal combustion engines, fuel combustion results in the formation of substantial amounts of water and various acidic gases (e.g., $CO_2$, $SO_x$, $NO_x$, HCl). Inevitably, a portion of this water and acidic material leaks past the rings and condenses in various internal areas of the engine, causing rusting. The problem is particularly critical when this rusting causes sticking and malfunction of closely fitting parts in hydraulic valve lifter systems and oil pump relief valves.

Traditionally, alleviation of rusting has been obtained by including an overbased sulfonate in the oil formation. Typically, the overbased sulfonate contains a metal carbonate which dissolves in the produced water and tends to neutralize the water-soluble acids. In addition, the sulfonate itself has some tendency to preferentially wet the ferrous engine surfaces and hence to displace adsorbed water droplets. Unfortunately, this protection is usually inadequate thereby often requiring the use of supplemental additives, such as alkyl phenolethylene oxide condensates. Even with the aid of supplemental additives, protection is often inadequate to prevent serious rusting of engines where operation is such as to condense much blowby or where periods between oil drains are long.

It is therefore apparent that a need exists for improved rust inhibitors which will alleviate the problems discussed in the foregoing.

I have found that certain acidic derivatives of benzene, while not soluble themselves in mineral oil, can be complexed into mineral oil by means of alkenyl succinimide dispersants. Under such conditions these acidic derivatives of benzene are effective as rust inhibitors. Still further, a synergism in rust inhibition is provided by a combination of the designated materials with overbased sulfonates.

PRIOR ART STATEMENT

A search of the prior art produced the following references as being of general interest.

U.S. Pat. No. 3,897,350 teaches lubricating oil compositions containing overbased sulfonates and certain acidic naphthalene derivatives (e.g. 2-naphthol).

U.S. Pat. No. 3,245,908 teaches lubricating compositions comprising a major amount of lubricating oil and minor amounts of an alkenyl succinimide dispersant and 2,2'-biphenyldicarboxylic acid.

U.S. Pat. No. 3,245,909 contains teachings similar to U.S. Pat. No. 3,245,908 with the exception that the lubricant composition contains 2,4-dihydroxybenzoic acid.

U.S. Pat. No. 3,245,910 contains teachings similar to U.S. Pat. No. 3,245,908 with the exception that the lubricant composition contains p-phenylene diacetic acid.

U.S. Pat. No. 3,679,585 teaches lubricant compositions comprising (a) base oil, (b) succinimide dispersant, and (c) oil-soluble alcohol or ester. The esters can be derived from carboxylic acids such as alkyl substituted benzoic, salicylic resorcylic, anthranilic and naphthoic.

U.S. Pat. No. 2,775,560 teaches corrosion-inhibiting lubricating oil compositions containing aliphatic monocarboxylic acids in addition to other ingredients such as partial or full amides of alkyl- or alkenyl-succinimide acids.

U.S. Pat. No. 3,591,496 teaches lubricating oils containing overbased derivatives.

U.S. Pat. No. 3,427,245 teaches mixtures of aliphatic hydrocarbon substituted succinamic acid amine salts, wherein the amine is a secondary amine, are provided for use under extreme corrosion conditions, particularly phosphate lubricants.

A review of the references indicates that they do not teach the specific composition which is Applicant's invention.

BRIEF SUMMARY OF THE INVENTION

Broadly stated, the present invention is directed to a lubricating oil composition, having improved rust inhibition, which comprises:

(a) a major amount of a base lubricating oil,
(b) a minor amount of an alkenyl succinimide dispersant, and
(c) a corrosion inhibiting amount of certain specific acidic derivatives of benzene.

In one aspect the lubricating oil composition contains additionally an overbased sulfonate.

DETAILED DESCRIPTION

The base lubricating oil can be a conventionally refined mineral lubricating oil, a synthetic hydrocarbon lubricating oil, or a synthetic lubricating oil, such as polymers of propylene, polyoxyalkylenes, dicarboxylic acid esters, and esters of phosphorus.

The mineral lubricating oils are well known to those skilled in the art. Both light viscosity (e.g., pale oils) and heavy viscosity (e.g., bright stock) oils can be used. A complete description of mineral lubricating oils is provided by Nelson's "Petroleum Refinery Engineering"(McGraw-Hill, New York, 1958).

Suitable synthetic hydrocarbon lubricating oils include di-n-long-chain alkaryls, as described hereinafter, linear mono-olefin oligomers, and a composition consisting essentially of di-n-long-chain alkaryls and trialkyl-substituted tetrahydronaphthalenes.

Linear mono-olefin oligomers, which are suitable as lubricating oils, are described in several U.S. Pat. Nos., e.g., 3,382,291, 3,149,178, and 3,808,134.

A particularly suitable linear mono-olefin oligomer composition is prepared from $\alpha$-olefins containing 6 to 16 carbon atoms, more suitably 8 to 12 carbon atoms, and preferably 10 carbon atoms. The linear mono-olefin oligomer composition contains at least 50 weight percent, more usually at least 60 weight percent, of materials containing 24 to 60 carbon atoms.

Di-n-long-chain alkaryls and trialkyl-substituted tetrahydronaphthalenes which are suitable in my invention are described in U.S. Pat. No. 3,926,823, which is made a part of this disclosure.

Preferred di-n-long-chain alkaryls are di-n-$C_{10}$-$C_{14}$ alkylbenzenes.

Alkenyl succinimides are well known. They are the reaction product of a polyolefin polymer-substituted succinic anhydride with an amine, preferably a polyalkenyl polyamine. The polyolefin polymer-substituted succinimide anhydrides are obtained by the reaction of a polyolefin polymer or a derivative thereof with maleic anhydride. The succinic anhydride thus obtained is reacted with the amine. The preparation of the alkenyl succinimides has been described many times in the art. See, for example, U.S. Pat. No. 3,390,082, in Cols. 2 through 6, wherein such a description is set forth. The alkenyl succinimides prepared by the techniques set forth therein are suitable for use in the present invention.

Particularly good results are obtained with the lubricating oil compositions of this invention when the alkenyl succinimide is derived from a polyisobutene-substituted succinic anhydride and a polyalkylene polyamine.

The polyisobutene from which the polyisobutene-substituted succinic anhydride is derived is obtained from the polymerization of isobutene and can vary widely in its compositions. The average number of carbon atoms can range from 30 or less to 250 or more, with a resulting number average molecular weight of about 400 or less to 3000 or more. Preferably, the average number of carbon atoms per polyisobutene molecule will range from about 50 to about 100 with the polyisobutenes having a number average molecular weight of about 600 to about 1500. More preferably, the average number of carbon atoms per polyisobutene molecule ranges from about 60 to about 90, and the number average molecular weight range from about 800 to about 1300. The polyisobutene is reacted with maleic anhydride according to well-known procedures to yield the polyisobutene-substituted succinic anhydride.

The substituted succinic anhydride is reacted with a polyalkylene polyamine to yield the corresponding succinimide. Each alkylene radical of the polyalkylene polyamine usually has up to about 8 carbon atoms. The number of alkylene radicals can range up to about 8. The alkylene radical is exemplified by ethylene, propylene, butylene, trimethylene, tetramethylene, pentamethylene, hexamethylene, octamethylene, etc. The number of amino groups generally, but not necessarily, is one greater than the number of alkylene radicals present in the amine, i.e., if a polyalkylene polyamine contains 3 alkylene radicals, it will usually contain 4 amino radicals. The number of amino radicals can range up to about 9. Preferably, the alkylene radical contains from about 2 to about 4 carbon atoms and all amine groups are primary or secondary. In this case the number of amine groups exceeds the number of alkylene groups by 1. Preferably the polyalkylene polyamine contains from 3 to 5 amine groups. Specific examples of the polyalkylene polyamines include ethylenediamine, diethylenetriamine, triethylenetetramine, propylenediamine, tripropylenetetramine, tetraethylenepentamine, trimethylenediamine, pentaethylenehexamine, di-(trimethylene)triamine, tri-(hexamethylene)tetraamine, etc.

Other amines suitable for preparing the alkenyl succinimide useful in this invention include the cyclic amines such as piperizine, morpholine and dipiperizines.

Preferably the alkenyl succinimides used in the compositions of this invention have the following formula:

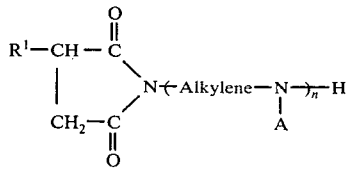

wherein:

a. $R^1$ represents an alkenyl group, preferably a substantially saturated hydrocarbon prepared by polymerization of aliphatic mono-olefins, (preferably $R^1$ is derived from isobutene and has an average number of carbon atoms and a number average molecular weight as described above).

b. the "Alkylene" radical represents a substantially hydrocarbyl group containing up to about 8 carbon atoms and preferably containing from about 2–4 carbon atoms as described hereinabove, c. A represents a hydrocarbyl group, an amine-substituted hydrocarbyl group, or hydrogen. The hydrocarbyl group and the amine-substituted hydrocarbyl groups are generally the alkyl and amino-substituted alkyl analogs of the alkylene radicals described above (preferably A represents hydrogen), and d. *n* represents an integer of from about 1 to 10, and preferably from about 3–5.

Overbased sulfonates, also known as hyperbasic sulfonates, are well-known in the lubricating oil additives art. Broadly, they refer to sulfonates containing an excess of basic compounds, which can be represented by the formula M-X wherein M is barium, calcium or magnesium and X is hydroxide or carbonate. A preferred basic compound is magnesium carbonate.

Overbased magnesium sulfonates are described more completely in U.S. Pat. No. 3,150,089, which is made a part of this disclosure. The magnesium carbonate content of the overbased sulfonate can be in the range of about 3.7 percent (weight) to about 30 percent by weight.

Overbased calcium sulfonates are described more completely in U.S. Pat. No. 3,150,088, which is made a part of this disclosure. The calcium carbonate content of the overbased sulfonate can be in the range of about 4.4 percent by weight to about 36 percent by weight.

Suitable acidic derivatives of benzene for use in my invention are the following:

(a) anthranilic acid (2-amino benzoic acid)

(b) 2-amino-5-alkylbenzoic acid wherein the alkyl group is methyl or ethyl, but preferably is methyl, and (c) 4-alkyl catechol wherein the alkyl group is methyl or ethyl, but preferably is methyl.

The amounts of materials which are used in the lubricating oil compositions, both suitable and preferred ranges, are shown in the following table.

| Material | Suitable | Preferred |
|---|---|---|
| | Weight Percent | |
| Alkenyl succinimide dispersant | 0.5–10 | 4–8 |
| Acidic derivative of benzene | 0.06–1 | 0.12–0.50 |
| Overbased sulfonate* | 0.1–5 | 1–3 |

*Optional

It is to be understood that other conventional lubricating oil additives, for example viscosity index improvers, extreme pressure agents and oxidation inhibitors, can be used in the lubricating oil composition of my invention.

In order to illustrate the nature of the present invention still more clearly the following examples will be given. It is to be understood, however, that the invention is not to be limited to the specific conditions or details set forth in these examples except insofar as such limitations are specified in the appended claims.

EXAMPLE 1

This example shows that an alkenyl-succinimide-type dispersant is required to solubilize the acidic derivative of benzene. In the test 40 grams of dispersant, 30 grams of Mid-Continent base oil having a viscosity of 100 SSU at 100° F. (37.8° C.) and 5 grams of anthranilic acid were heated to approximately 130° C. The results are shown in Table I.

Table I

| Dispersant | Solubility Behavior |
|---|---|
| Alkenyl succinimide Type A* | Soluble, bright and stable liquid at room temperature for months; easily soluble in additional mineral oil |
| Alkenyl succinimide Type B** | " |
| Alkenyl succinimide Type C*** | " |
| Partial Succinimide (1) | Soluble hot and initially at room temperature, but recrystallization starts by 24 hours and is marked at 1 week |
| Alkyl succinic ester (2) | Partially soluble hot, major recrystallization on slight cooling to solid 2-phase matrix |
| Non-succinimide (3) | Soluble hot, major recrystallization on minor cooling |
| Non-succinimide (4) | Turbid hot, slow recrystallization on cooling |

*Type A - "Oronite" OLOA 1200
**Type Type B - Cooper E644
***Type C - Monsanto 5070B
(1) Oronite OLOA 373C
(2) Lubrizol 936
(3) Lubrizol 6401
(4) Amoco 9250

EXAMPLE 2

Example 1 was repeated substituting a variety of other types of lubricant additives for the alkenyl succinimide dispersant. The anthranilic acid was not soluble in viscosity index improvers, zinc dithiophosphates, or overbased sulfonates.

EXAMPLE 3

This example illustrates which acidic derivatives of benzene are soluble in alkenyl succinimide dispersant and several which are not.

The procedure was the same as for Example 1. The results are shown in the following table.

Table II

| Suitable Solubility |
|---|
| o-aminobenzoic acid (anthranilic acid) |
| m-aminobenzoic acid |
| N-methylanthranilic acid |
| N-dimethyl-3-aminobenzoic acid |
| 2-amino-5-methylbenzoic acid |
| catechol |
| 4-methylcatechol |
| resorcinol |
| 2-methylresorcinol |
| salicylic acid |
| thiosalicylic acid |

Table II-continued

| |
|---|
| 5-methylsalicylic acid |
| Insoluble or Recrystallizing |
| o-aminophenol |
| m-aminophenol |
| p-aminophenol |
| p-aminobenzoic acid |
| 2-amino-p-cresol |
| 6-amino-m-cresol |
| N-dimethyl-3-aminophenol |
| 2-hydroxypyridine |
| m-hydroxybenoic acid |
| p-hydroxybenzoic acid |
| phthalic acid |
| isophthalic acid |
| terephthalic acid |
| hydroquinone |
| 2-amino-3-hydroxypyridine |

EXAMPLE 4

This example shows the results obtained using a bench-scale rust test on most of the acidic derivatives of benzene shown to be soluble in Example 3 plus the results on 2-naphthol, which is taught in U.S. Pat. No. 3,897,350.

The test employed 600 ml. of oil blend, 150 ml. of gasoline and 100 ml. of a standardized acid mix (sulfuric, nitric, and hydrochloric acids). The admixture was placed in an Erlenmeyer flask with magnetic stirrer and reflux condenser to avoid gasoline loss. A polished hydraulic valve lifter was suspended in the stirred mix for 23 hours and then inspected for rust and corrosion. A series of standards were used for rating the lifter on a 0–10 merit scale. Prior correlations had indicated that ratings of 8.3 or better were required to pass Sequence II-C double length (64 hours) engine rust tests.

The bench tests were run on an oil blend containing:
9.0% (wt.) alkenyl succinimide dispersant
1.9% (wt.) zinc dithiophosphate (9.1% Zn)
2.0% (wt.) calcium phenate/phosphonate (1.65% Ca)
2.0% (wt.) overbased sulfonate (11.7% Ca)
7.5% (wt.) methacrylate V.I. improver
0–0.5% — benzenoid compound
Balance — Mid-Continent base oil having a viscosity of 100 SSU at 100° F. (37.8° C.)

The compounds tested and the results were as follows:

| Benzenoid Compound | Concentration (%) 0 | ⅛ | ½ |
|---|---|---|---|
| None | 8.3 | | |
| 2-amino-5-methylbenzoic acid (1) (5-methylanthranilic acid) | | 8.4 | 9.1 |
| 4-methylcatechol (1) | | 8.6 | 8.8 |
| anthranilic acid (1) | | 7.1 | 8.9 |
| 2-naphthol (U.S. 3,897,350) (2) | | 8.4 | 8.6 |
| N-methylanthranilic acid (3) | | 8.2 | 5.9 |
| N-dimethyl-3-aminobenzoic acid (3) | | 7.4 | 7.2 |
| salicylic acid (3) | | 8.1 | 6.0 |
| thiosalicylic acid (3) | | 7.1 | 6.8 |
| catechol (3) | | 8.4 | 6.0 |
| resorcinol (3) | | 8.4 | 8.3 |

(1) These compounds were superior to the reference standard, particularly at the 0.5% concentration.
(2) This compound was inferior to all of the other listed above it. While the difference was only slight compared to anthranilic acid there was a difference at the 0.5% concentration.
(3) These compounds were either similar or in most instances inferior to the reference standard.

EXAMPLE 5

This example shows the beneficial effects of using the alkenyl succinimide in combination with the acidic derivative of benzene.

The test procedure was the same as in Example 4.

The test blends contained:

8.0% (wt.) total dispersant
1.9% (wt.) zinc dithiophosphate (9.1% Zn)
2.0% (wt.) calcium phenate/phosphonate (1.65% Ca)
2.4% (wt.) overbased sulfonate (11.7% Ca)
7.5% (wt.) methacrylate V.I. improver
0–0.5% 5-methylanthranilic acid
Balance — Mixture of Mid-Continent base oils having viscosities of 100 and 170 SSU at 100° F. (37.8° C.)

| Dispersant | Rating at 5-Methylanthranilic Acid Content | | | |
|---|---|---|---|---|
| | 0 | 0.125 | 0.25 | 0.50 |
| All non-succinimide (1) | 7.9–8.1 | | | |
| Mixture of non-succinimide (1) and succinimide Type A (2) | | 9.1* | 9.3** | 9.1*** |
| Mixture of non-succinimide (1) and succinimide Type B (3) | | 9.3* | 8.9** | 8.4*** |

(1) a succinamide - "Amoco 9250"
(2) "Oronite" OLOA 1200
(3) Cooper E644
*Amoco 9250 - 7.25% - succinimide - 0.75%
**Amoco 9250 - 6.50% - succinimide - 1.50%
***Amoco 9250 - 5.00% - succinimide - 3.00%

EXAMPLE 6

This example illustrates the effectiveness of the acidic derivative of benzene in the double length (64 hours) Sequence II-C engine rust test.

The Sequence II-C double length (64 hours) test is as follows.

The test involves the operation of a 1967 Oldsmobile, 425 cu. in., V-8 engine under low-speed, low-temperature conditions. Upon completion of the test (64 hours), the engine is inspected for evidence of rust and valve lifter sticking.

The engine operating conditions are as follows:

| Operating Conditions | 1–28 Hrs. | 29–30 Hrs. | 31–32 Hrs. |
|---|---|---|---|
| Speed, rpm | 1,500 ± 20 → | | 3,600 ± 20 |
| Load, BHP | 25 ± 2 → | | 100 ± 2 |
| Oil, to engine, after filter, deg. F | 120 ± 2 → | | 260 ± 2 |
| Oil pump outlet, psi | 50 ± 10 → | | |
| Coolant, jacket out, deg. F | 110 ± 1 | 120 ± 1 | 200 ± 2 |
| jacket in, deg. F | 105 ± 1 | 115 ± 1 | 190 ± 2 |
| jacket flow rate GPM | 60 ± 1 → | | 60 ± 1 |
| intake crossover out, deg. F | 109 ± 2 | 119 ± 2 | 197 ± 2 |
| crossover pressure outlet, psi | 2.5 ± 0.5 → | | — |
| breather tube out, deg. F | 60 ± 2 → | | 199 ± 2 |
| rocker covers out, deg. F | 60 ± 2 → | | 198 ± 2 |
| Coolant Out, rocker cover pressure psi | 5.0 ± 0.5 → | | 5.0 ± .05 |
| Air-fuel ratio | 13.0 ± 0.5 → | | 16.5 ± 0.5 |
| Carburetor, air temp. deg. F | 80 ± 2 → | | 80 ± 2 |
| air humidity, grains/Lb. of dry air | 80 ± 5 → | | 80 ± 5 |
| pressure, inches water | 0.1 to 0.3 → | | 0.1 to 0.3 |
| Blowby rate, cfm at 100° F and 29.7" Hg. | 0.8 ± 0.1 → | | 2.2 ± 0.2 |
| Intake manifold Vac. inches Hg. | 18 ± 1.5 → | | 11 ± 2.5 |
| Exhaust back pressure, inches water | 4 ± 1 → | | 30 ± 2 |
| Exhaust back pressure, max. diff. in water | 0.2 → | | 0.2 |

The test oils were similar to that in Example 5 with the following variants.

| Oil A | Oil B |
|---|---|
| 8% non-succinimide (Amoco 9250) | 6.5% non-succinimide (Amoco 9250) + 1.5% succinimide (Oronite OLOA 1200) |
| No 5-methylanthranilic acid | 0.25 wt.% 5-methyl-anthranilic acid |

The test results were as follows:

| | Oil A | Oil B |
|---|---|---|
| Overall Rating | 8.25 | 8.99 |
| Lifter bodies | 8.26 | 8.5 |
| Plungers | 9.04 | 9.5 |
| Balls | 8.56 | 9.5 |
| Relief Valve Plunger | 8.7 | 9.2 |
| Push Rods | 6.7 | 8.26 |
| Stuck Lifters or Relief Valve | None | None |

It should be noted that an overall rating of 8.4 is required for a "pass" at normal Sequence II-C length of 32 hours. Even in the double length test used to demonstrate utility for long-drain service, Oil B gave results much better than required.

Thus, having described the invention in detail, it will be understood by those skilled in the art that certain variations and modifications may be made without departing from the spirit and scope of the invention as defined herein and in the appended claims.

I claim:

1. A lubricating oil composition, having improved rust inhibiting properties, said composition comprising (a) a major amount of a base lubricating oil, (b) from about 0.5 to about 10 weight percent of an alkenyl succinimide dispersant and (c) a rust inhibiting amount, in the range of about 0.06 to about 1 weight percent of an acidic derivative of benzene selected from the group consisting of anthranilic acid, 2-amino-5-alkylbenzoic acid, wherein the alkyl group is methyl or ethyl, and 4-alkyl catechol, wherein the alkyl group is methyl or ethyl.

2. The lubricating oil composition of claim 1 wherein the base oil is a mineral oil.

3. The lubricating oil composition of claim 2 wherein the acidic derivative of benzene is anthranilic acid.

4. The lubricating oil composition of claim 2 wherein the acidic derivative of benzene is 2-amino-5-methylbenzoic acid.

5. The lubricating oil composition of claim 2 wherein the acidic derivative of benzene is 4-methyl catechol.

6. The lubricating oil composition of claim 1 wherein the base oil is a synthetic lubricating oil selected from the group consisting of synthetic hydrocarbons, polymers of propylene, polyoxyalkylene, dicarboxylic acid esters and esters of phosphorus.

7. The lubricating oil composition of claim 6 wherein the acidic derivative of benzene is anthranilic acid.

8. The lubricating oil composition of claim 6 wherein the acidic derivative of benzene is 2-amino-5-methylbenzoic acid.

9. The lubricating oil composition of claim 6 wherein the acidic derivative of benzene is 4-methyl catechol.

10. The lubricating oil composition of claim 1 wherein it contains from about 0.1 to about 5 weight percent of an overbased metal sulfonate.

11. The lubricating oil composition of claim 10 wherein the alkenyl succinimide dispersant is represented by the formula

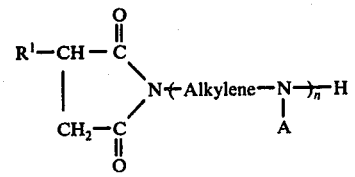

wherein:

(a) $R^1$ represents an alkenyl group, (b) the "Alkylene" radical contains from 1 to 8 carbon atoms, (c) A represents a hydrocarbyl group, an amine-substituted hydrocarbyl group, or hydrogen, and, (d) *n* represents an integer of from 1 to 10.

12. The lubricating oil composition of claim 11 wherein the acidic derivative of benzene is anthranilic acid.

13. The lubricating oil composition of claim 11 wherein the acidic derivative of benzene is 2-amino-5-methylbenzoic acid.

14. The lubricating oil composition of claim 11 wherein the acidic derivative of benzene is 4-methyl catechol.

* * * * *